US006676334B2

(12) United States Patent
Horton, III

(10) Patent No.: US 6,676,334 B2
(45) Date of Patent: Jan. 13, 2004

(54) WORK MODULE SUPPORT VESSEL

(75) Inventor: Edward E. Horton, III, Houston, TX (US)

(73) Assignee: Deepwater Technologies, Inc., Houston, TX (US)

( * ) Notice: Subject to any disclaimer, the term of this patent is extended or adjusted under 35 U.S.C. 154(b) by 0 days.

(21) Appl. No.: 10/167,325

(22) Filed: Jun. 10, 2002

(65) Prior Publication Data

US 2003/0226490 A1 Dec. 11, 2003

(51) Int. Cl.[7] ..... E02B 25/00; B63B 35/40

(52) U.S. Cl. ..... 405/205; 405/195.1; 405/206; 405/209; 114/259

(58) Field of Search ..... 405/195.1, 201, 405/203–207, 209; 114/259, 260, 258, 264–267, 223, 253, 49, 122

(56) References Cited

U.S. PATENT DOCUMENTS

| | | | | | |
|---|---|---|---|---|---|
| 2,551,375 | A | * | 5/1951 | Hayward | 405/207 |
| 3,776,167 | A | * | 12/1973 | Marbury, Jr. | 114/259 |
| 4,157,023 | A | * | 6/1979 | Tisdale et al. | 405/168.3 |
| 4,537,533 | A | * | 8/1985 | Hampton | 405/205 |
| 4,710,060 | A | * | 12/1987 | Kamarainen | 405/166 |
| 4,747,334 | A | * | 5/1988 | Kuriiwa | 114/259 |
| 4,867,611 | A | * | 9/1989 | Luyties | 405/209 |
| 4,898,112 | A | * | 2/1990 | McGlew et al. | 114/259 |
| 5,997,217 | A | * | 12/1999 | Verret | 405/201 |
| 6,155,190 | A | * | 12/2000 | Cavanagh | 114/45 |
| 6,213,045 | B1 | | 4/2001 | Gaber | |
| 6,257,165 | B1 | * | 7/2001 | Danos et al. | 114/265 |
| 6,299,383 | B1 | * | 10/2001 | Finn et al. | 405/209 |
| 6,302,049 | B1 | | 10/2001 | Weiler | |
| 6,354,765 | B2 | * | 3/2002 | Jones | 405/203 |

FOREIGN PATENT DOCUMENTS

| | | | | |
|---|---|---|---|---|
| EP | 332500 | * | 9/1989 | 114/260 |
| GB | 2154527 | * | 9/1985 | 114/264 |
| GB | 2225365 | * | 3/1990 | 405/203 |
| JP | 61115794 | * | 6/1986 | 114/260 |

OTHER PUBLICATIONS

Couprie, Stephanie et al.; "Steel Hybrid Riser Extends.." Offshore May 2001, pp. 134–135.

* cited by examiner

*Primary Examiner*—Jong-Suk (James) Lee
(74) *Attorney, Agent, or Firm*—Klein, O'Neill & Singh, LLP

(57) ABSTRACT

An offshore construction system comprises a work module support vessel having a ballast-down mode, in which a deck of the vessel is submerged below the water surface, and a ballast-up mode, in which the deck is disposed above the water surface. The system further comprises an independently floatable, pontoon-supported work module carried on the deck of the support vessel. The system also includes a draw connected between the work module and the work module support vessel. The draw has a draw-over mode, in which the work module is drawn over the deck of the support vessel, and a remove mode, in which the work module is removed from the deck.

13 Claims, 4 Drawing Sheets

WORK MODULE SUPPORT VESSEL

BACKGROUND OF THE INVENTION

Most work vessels are barges and are held with mooring lines or are dynamically positioned. Mobilization and demobilization of these conventional work vessels are done dockside, which takes several weeks and ties up the vessel. Furthermore, conventional work vessels are specifically designed to perform a narrow group of tasks. Even further, each vessel must itself be seaworthy. Therefore, when the tasks that the vessel is designed to do are not in operation, the vessel experiences down time. Down time is costly.

Thus, there is a long felt need for a modular system, which is cost effective, able to perform a large number of tasks, and requires shorter mobilization and demobilization times.

SUMMARY OF THE INVENTION

The problems described above are addressed, according to one example embodiment of the invention, with a work module support vessel that is designed to carry, on its deck, various types of work modules. Each type of work module performs a specific set of tasks. This allows the work module support vessel to perform a wide range of services used in construction and maintenance activities for offshore oil and gas operations.

In one example embodiment, an offshore construction system is provided. The system comprises a work module support vessel and a pontoon-supported work module. The work module is designed to perform a specific set of tasks related to offshore oil and gas operations in open waters. The work module support vessel carries on its deck one or more pontoon-supported work modules and is capable of ballasting down a sufficient depth to allow the pontoon-supported work modules to float over the stern portion of the deck of the vessel and be positioned on guide rails at selected points. The support vessel is equipped with a jacking system to skid the work modules on and off the support vessel.

In a further embodiment of the present invention, an offshore construction system is provided. The offshore construction system comprises a work module support vessel having a ballast-down mode, in which a deck of the work module support vessel is submerged, and a ballast-up mode, in which the deck is above water. The system further comprises a pontoon-supported work module carried on the deck of the support vessel. The system further comprises a draw connected between the work module and the work module support vessel having a draw-over mode, in which the work module is drawn over the deck, and a remove mode, in which the work module is removed from the deck.

DETAILED DESCRIPTION OF EXAMPLE EMBODIMENTS OF THE INVENTION

Figure 1:
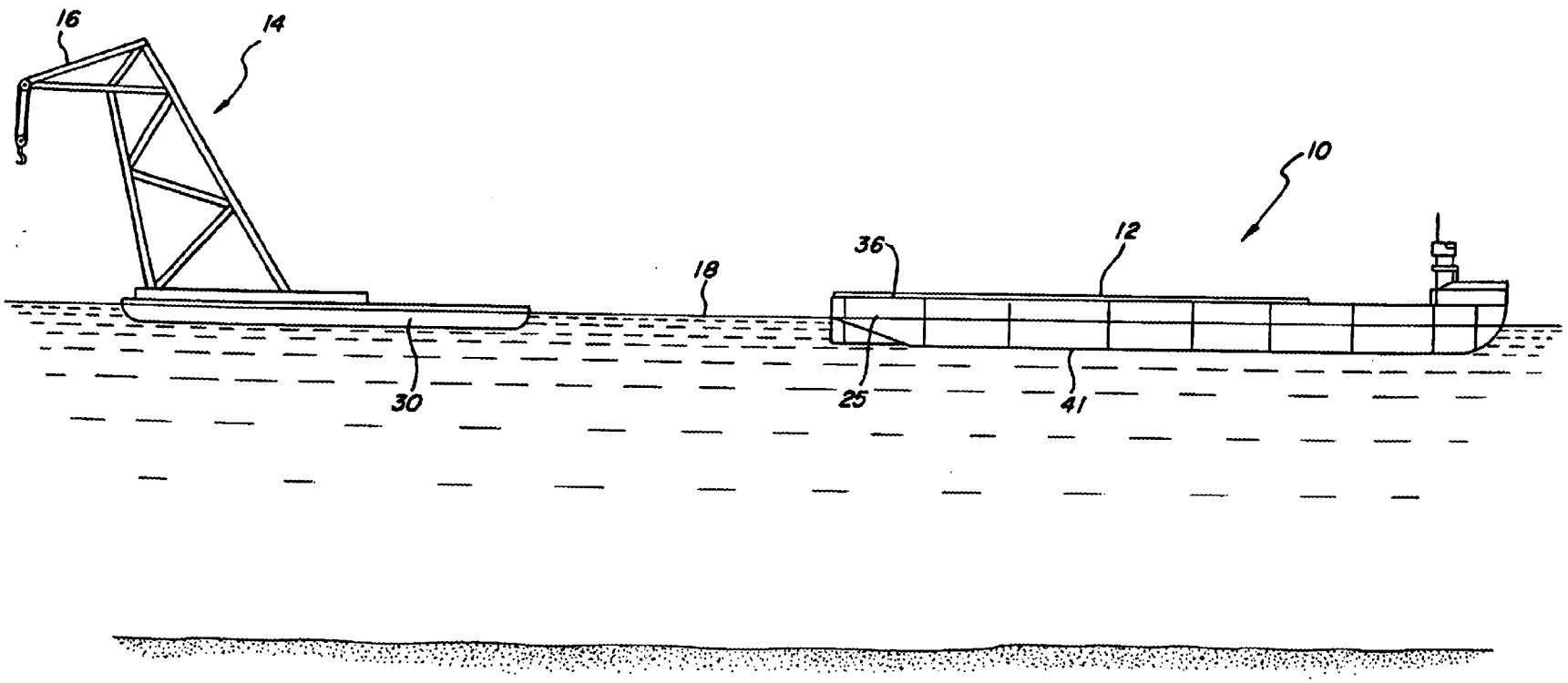
FIG. 1 shows a side view of an example embodiment of a work module support vessel towing a work module.
Figure 2:
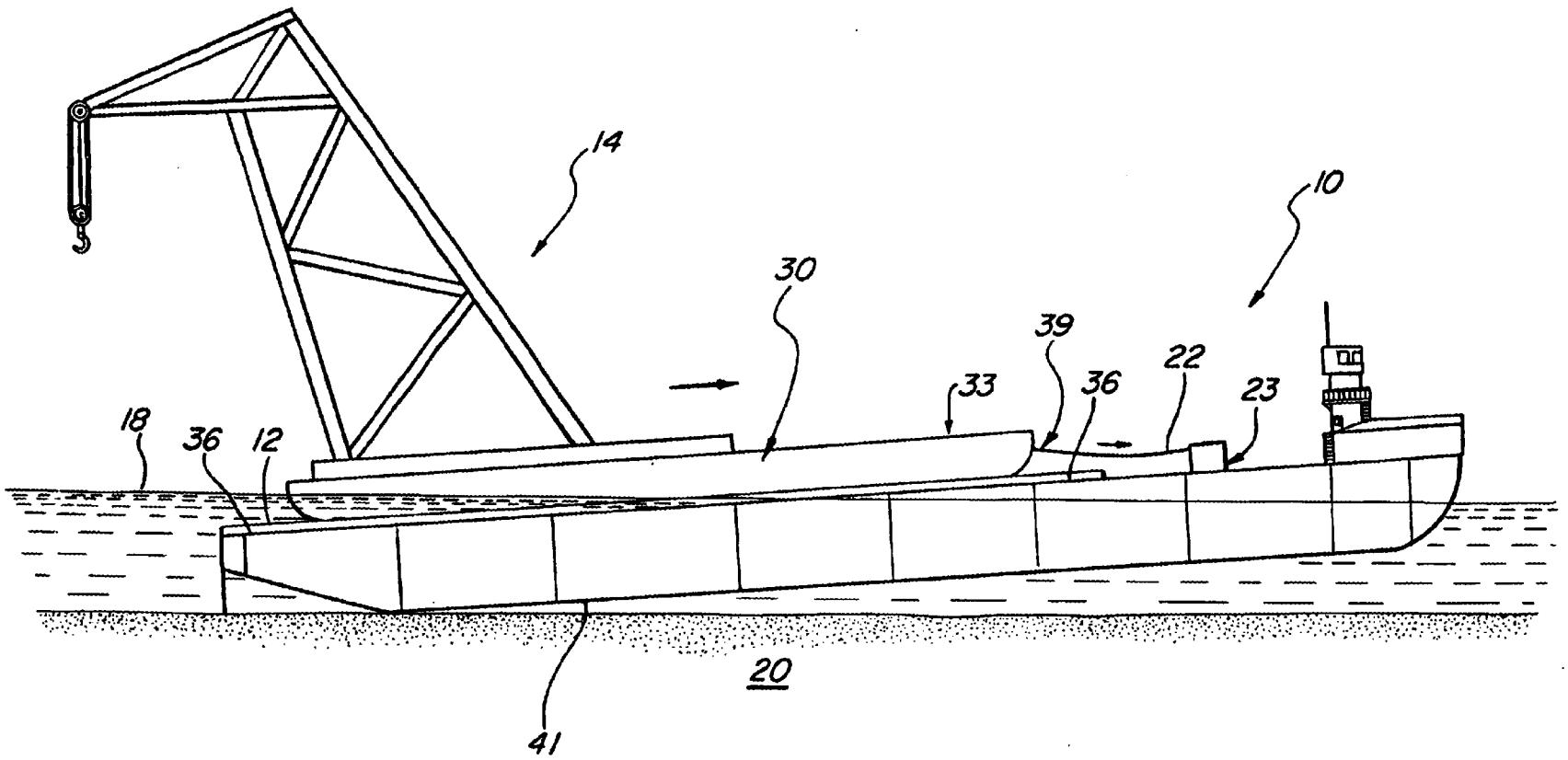
FIG. 2 shows a side view of an example embodiment of a work module support vessel deballasted to the seafloor and supporting a work module.

In one example embodiment, as illustrated in FIGS. 1 and 2, an offshore construction system is provided. The offshore construction system comprises a work module support vessel 10 having a ballast-down mode, in which a deck 12 of the work module support vessel 10 is submerged, and a ballast-up mode, in which the deck 12 is above water 18. A pontoon-supported work module 14 is carried on the deck 12 of the support vessel. The system further comprises a draw 39 connected between the work module 14 and the work module support vessel 10 having a draw-over mode, in which the work module 14 is drawn over the deck 12, and a remove mode, in which the work module 14 is removed from the deck 12. The work module 14 is designed to perform a specific set of offshore tasks related to offshore oil and gas operations in open waters.

As illustrated in FIG. 1, the work module support vessel 10 is seen in one embodiment of its ballast-up mode and is seen floating with the vessel deck 12 above the waterline 18. Floating behind the work module support vessel 10 is the work module 14. In the illustrated example, the work module 14 includes a crane 16. The work module 14, in alternate embodiments, includes other equipment specifically designed for various offshore tasks related to offshore oil and gas operations. For example, in alternate embodiments, the work module 14 comprises a transportation module, a pipe-laying module, a fixed-ballast-installation module, a well-servicing module, a survey module, a mooring-system-installation module, a drilling module, and/or any other work module 14 that will occur to those of ordinary skill in the art.

Referring now to FIG. 2, the work module support vessel 10 is seen in its ballast-down mode. The work module support vessel 10 is ballasted down such that the vessel deck 12 is below the waterline 18. The work module 14 is then floated over the vessel deck 12. In the illustrated example, the work module support vessel's bottom 41 rests on the sea bottom 20. By having the bottom 41 of the vessel 10 resting on the seafloor 20, the stability of the vessel 10 is greatly improved. In addition, a shallow water location where the work module 14 is secured to the vessel 10, is not subject to harsh environmental conditions, and thus, the operation is less weather sensitive.

After the work module 14 is floated over the deck 12, the work module support vessel 10 is ballasted back up to a position in which the deck 12 is above the waterline 18. The work module 14 is used to do work while on the deck 12 of the work module support vessel 10.

In a further embodiment, illustrated in FIG. 2, the work module support vessel 10 further comprises guide rails 36 to guide the work module 14 onto the vessel 10. In a further embodiment, the work module support vessel 10 further comprises a draw 39, with a draw-over mode and a remove mode. The draw 39 is used to position the work module 14 on the guide rails 36 and force the work module 14 on (draw-over mode) and off (remove mode) the deck. In FIG. 2, the draw 39 is seen in its draw-over mode. Here, the work module 14 is being drawn over the deck 12. The arrow indicates the direction that the work module 14 is being moved. The draw 30 also has a remove mode (not illustrated), in which the work module 14 is removed from the deck 12.

In one embodiment, the draw 39 is capable of moving the modules 14 even when the stem 25 is not submerged. In one embodiment, the draw 39 comprises a jacking system 23 including a jacking line 22. In further alternate embodiments, the draw comprises a push-pull jacking system, a pull-in-pull-out jacking system, a winch 23 and jacking line 22, or any other draw 39 that will occur to those of ordinary skill.

In a further embodiment, the work module support vessel's 10 guide rails 36 and the work module 14 mate to allow the guide rails 36 to guide the work module 14 onto the deck 12 and to secure the work module 14 on the deck 12 once it has been guided there.

In various embodiments of the invention, the work module 14 is further secured to the work module support vessel 10 by straps, clamps, welds, and/or any other means that will occur to those of ordinary skill in the art without the need for further elaboration. Likewise, in various embodiments, the attachment of the work module 14 and the pontoon 30 is accomplished with mating members, straps, welds, bolts, common construction, or any other method that will occur to those of ordinary skill in the art.

In one embodiment, as illustrated in FIG. 2, the work module support vessel 10 has an open deck 12. In a further embodiment, the essentially flat deck 12 has some camber, and has no gunwales. Those of ordinary skill in the art will recognize that an essentially flat deck 12 is inexpensive to build and allows the work module 14 to be floated on the work module support vessel 10 from most any direction. Even further, because the deck 12 has no gunwales, the work module 14 is allowed to hang over the sides of the work module support vessel 10. This is advantageous because this extends the reach of the work module 14. For example, allowing a work module 14 with a crane 16, such as the crane 16 illustrated in FIG. 2, to extend beyond the sides of the work module support vessel 10 extends the reach of the crane 16.

Figure 3:
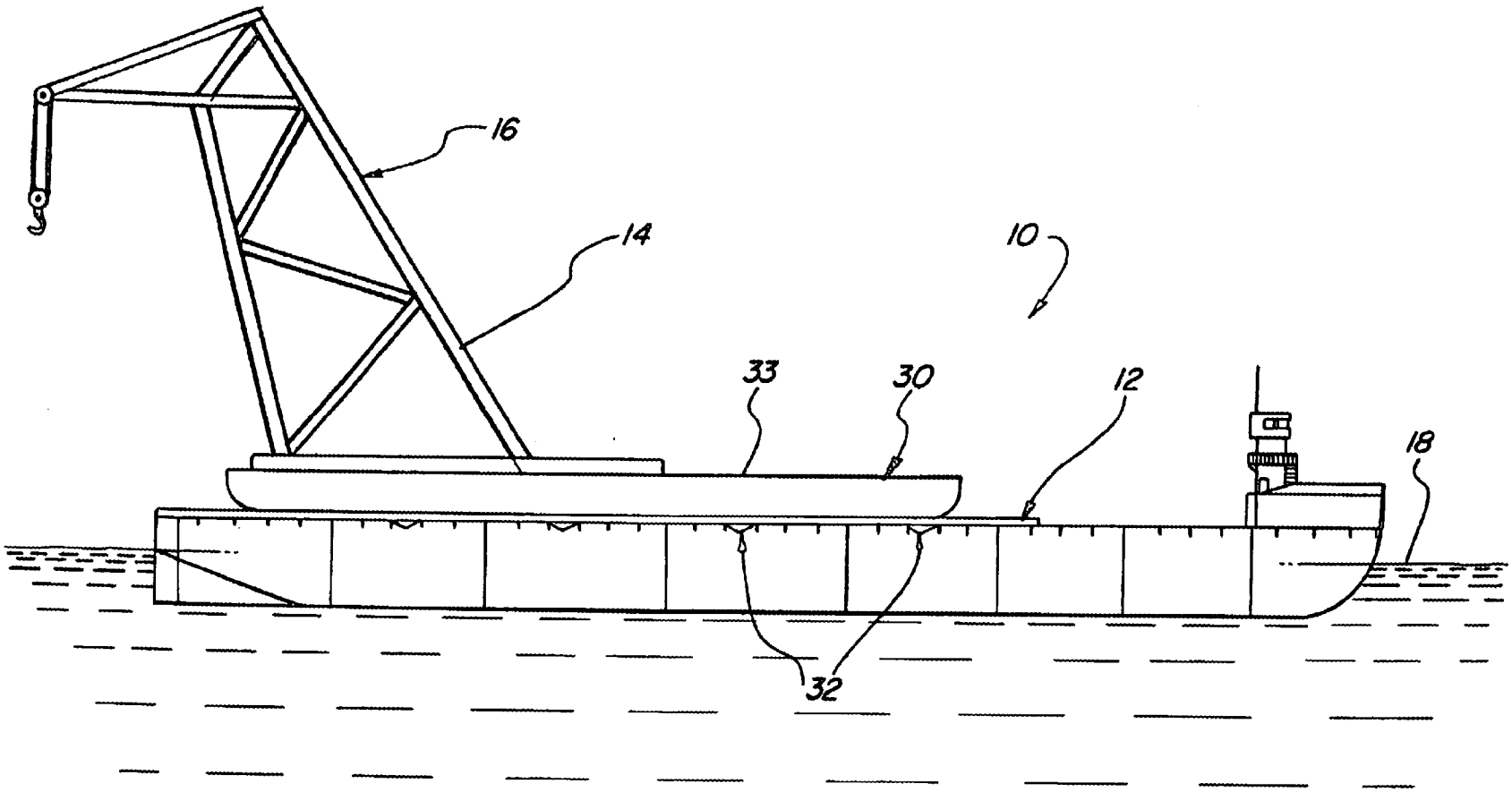
FIG. 3 shows a side view of an example embodiment of a pontoon supported work module being supported by a work module support vessel.

Referring now to FIG. 3, FIG. 3 shows the work module 14 resting on a pontoon 30 that rests on the vessel deck 12. The pontoon 30 includes additional work space 33 for other work modules (not illustrated). For example, in some embodiments, the pontoon 30 includes power systems for the operation of, for example, a crane 16, or any other task specific component of the various work modules 14. In some embodiments, cranes 16, work modules 14, power systems (not shown), or any other system that will occur to those of ordinary skill are installed onshore onto the pontoon 30. The pontoon 30 is then floated over the vessel deck 12.

Figure 4:
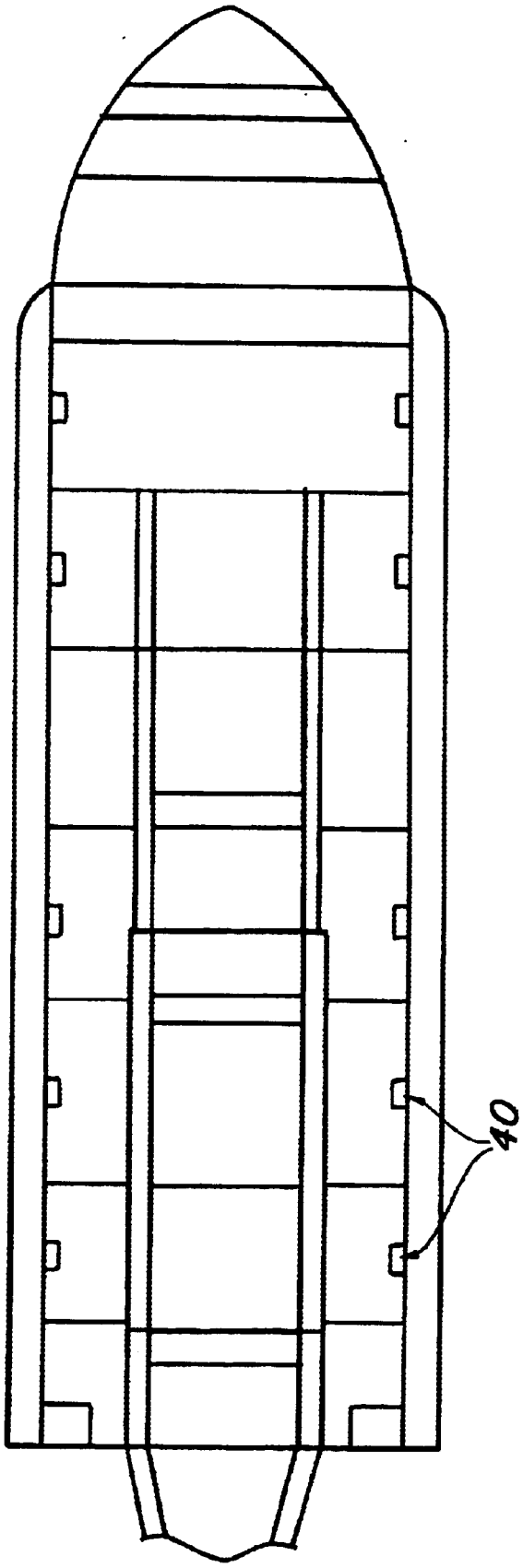
FIG. 4 shows a top view of an example embodiment of a work module being supported by a work module support vessel.

FIG. 4 is a top-view of an example embodiment of FIG. 3. In a further embodiment, the work module support vessel's 10 hull includes receptacles 40 for receiving stabilization members 32 (see FIG. 3) of a pontoon 30. The interaction of stabilization members 32 and receptacles 40 stabilizes the work module 14 to the deck 12 during transport and other operations.

In alternate embodiments, the work module support vessel 10 is a newly-built vessel, or a conversion from an existing vessel. Methods of converting a vessel from an existing use to a work module support vessel 10 will occur to those of ordinary skill in the art without further elaboration. In still a further embodiment, the work module support vessel 10 is outfitted with a roll stabilization system, a winching system, a dynamic positioning system, or any other maritime system for offshore construction operations that will occur to those of ordinary skill in the art.

In still a further embodiment, the work module support vessel 10 is completely seaworthy, while the work module 14 is not seaworthy. Those of ordinary skill in the art will recognize the cost effectiveness of having a task specific work module 14, which is not required to be seaworthy.

The work module support vessel 10 does not require a water-tight stern gate at the stern or gunwales. Thus, the work module support vessel 10 will be much cheaper to build or convert. Furthermore, the system does not require a docking probe, which is expensive and subject to mechanical downtime and failure.

Various example embodiments of the present invention support a wide range of work modules 14, and thus, the system will have a high utilization. Mobilization and demobilization time and cost will be reduced, because the work module 14 is, in some embodiments, mobilized dockside without the presence of the work module support vessel 10 or its marine crew. The work module 14 is installed and removed from the work module support vessel 10 in a short time.

The example embodiments described above are intended to be teaching examples to teach the broad aspect of the invention. They are in no way intended to be exhaustive of the scope of the present invention.

I claim:

1. An offshore construction system comprising:

a work module support vessel having an essentially flat, open deck, a ballast-down mode, in which the deck is submerged, and a ballast-up mode, in which the deck is above water;

a work module carried on the deck of the support vessel, the work module being supported on a buoyant pontoon such that the work module is floatable independently of the support vessel; and a draw connected between the work module and the work module support vessel, the draw having a draw-over mode, in which a stern of the work module support vessel is ballasted down to the sea-floor and the work module is drawn over the deck, and a remove mode, in which the work module is removed from the deck.

2. The system of claim 1, wherein the work module support vessel further comprises guide rails.

3. The system of claim 2, wherein the guide rails mate with the work module.

4. The system of claim 1, wherein said deck allows at least a portion of the work module to extend beyond a side of the deck.

5. The system of claim 1, wherein said draw further comprises a jacking system.

6. The system of claim 5, wherein said jacking system further comprises a winch.

7. The system of claim 5, wherein said jacking system further comprises a push-pull jacking system.

8. The system of claim 1, wherein the work module comprises a well-servicing module.

9. The system of claim 1, wherein the work module comprises a transportation module.

10. The system of claim 1, wherein the work module comprises a heavy-lifting module.

11. The system of claim 1, wherein the work module comprises a survey module.

12. The system of claim 1, wherein the work module comprises a fixed-ballast installation module.

13. The system of claim 1, wherein the work module comprises a mooring-system installation module.

* * * * *